United States Patent [19]

Takamoto et al.

[11] Patent Number: 4,770,352

[45] Date of Patent: Sep. 13, 1988

[54] COAL-WATER SLURRY PRODUCING SYSTEM

[75] Inventors: Shigehito Takamoto, Hiroshima; Nobuyasu Meguri, Kure, both of Japan

[73] Assignee: Babcock-Hitachi Kabushiki Kaisha, Tokyo, Japan

[21] Appl. No.: 39,274

[22] Filed: Apr. 17, 1987

[30] Foreign Application Priority Data

Apr. 17, 1986 [JP] Japan ..... 61-88933
Apr. 17, 1986 [JP] Japan ..... 61-88936

[51] Int. Cl.[4] ..... B02C 17/06

[52] U.S. Cl. ..... 241/72; 44/51; 241/80; 241/171

[58] Field of Search ..... 241/70, 71, 21, 72, 241/24, 79.3, 171, 80, 97, 176, 177, 178, 179; 44/1 B, 51

[56] References Cited

U.S. PATENT DOCUMENTS

| | | | |
|---|---|---|---|
| 1,461,977 | 7/1923 | Ewing, et al. | |
| 1,670,005 | 5/1928 | Pratt | 241/70 X |
| 1,787,897 | 1/1931 | Durnin | 241/72 |
| 2,160,169 | 5/1939 | Pontoppidan | 241/72 |
| 3,078,050 | 2/1963 | Hardinge | 241/70 X |
| 3,459,380 | 8/1969 | Kartman | 241/72 X |
| 3,887,142 | 6/1975 | McElvain. | |
| 4,500,041 | 2/1985 | Nakaoji et al. . | |

FOREIGN PATENT DOCUMENTS

| | | | |
|---|---|---|---|
| 1131974 | 6/1962 | Fed. Rep. of Germany. | |
| 798100 | 7/1958 | United Kingdom. | |
| 1216663 | 6/1962 | United Kingdom. | |
| 1159259 | 12/1966 | United Kingdom. | |
| 2014874 | 9/1979 | United Kingdom. | |
| 1103895 | 7/1984 | U.S.S.R. | 241/72 |

OTHER PUBLICATIONS

Mineral Processing Plant Design, Mular et al., 12-1978.
Process Engineering of Size Reduction: Ball Milling, Austin et al., 12-1984.
Cold Water Slurry as Utility Boiler Fuel, Scheffee et al., 3-1982.

*Primary Examiner*—Mark Rosenbaum
*Attorney, Agent, or Firm*—Antonelli, Terry & Wands

[57] ABSTRACT

A coal-water slurry producing system comprises: a continuous wet-type ball mill for grinding the coal with the addition of water and additives thereto to obtain coal-water slurry, supplying device for supplying the coal-water slurry discharged from the ball mill to a filtering apparatus, for filtering the supplied coal-water slurry to remove coal particles of a predetermined particle size or above, delivery device for delivering the filtered coal-water slurry containing coal particles of the predetermined particle size or below to a slurry storage tank, and a combustion apparatus. The coal-water slurry producing system further comprises a screen apparatus disposed at an exit of the ball mill to remove coarse coal particles contained in the coal-water slurry, and recovery device for recovering the removed coarse coal particles at an entrance of the ball mill.

6 Claims, 5 Drawing Sheets

$U_s = 1$ $U_s > 1$

COAL-WATER SLURRY PRODUCING SYSTEM

BACKGROUND OF THE INVENTION

1. Field of the Invention

The present invention relates to a coal-water slurry producing system having a mill for mixing a solid fuel such as coal and petroleum coke with water and grinding the same to produce a slurry. More particularly, the present invention relates to a coal-water slurry producing system incorporating an improved filtering apparatus for removing large solid particles in a slurry discharged from a mill and a ball mill used for said system.

2. Related Art Statement

A slurry of coal and water in which ground coal is mixed with water with the addition of additives such as a surface active agent and is made into a slurry is easy to handle in terms of transportion and storage. Therefore, research has been under way with regard to the use of such a coal-water slurry as a fuel for combustion apparatuses such as boilers.

It is required that a coal-water slurry used as a boiler fuel is such that the concentration of coal is about 60 wt. % or above and that the particle size is sufficiently small to allow 60–90 wt. % of the particles to pass through a 200-mesh screen. In order to obtain such a coal-water slurry, one method has been adopted which involves grinding coal with water and additives by means of a continuous wet-type ball mill.

In a coal-water slurry producing system having a continuous wet-type ball mill, coarse coal particles which have not been ground well are mixed in the coal-water slurry discharged from the mill. If the slurry with such coarse particles mixed therein is sent to a strainer, the load applied to the metal screen in the strainer becomes excessively large, so that the strainer becomes frequently blocked and may be damaged by the excessive load even if the strainer is designed with substantial leeway in terms of the filtering capacity of the metal screen. Since such a strainer per se is expensive, damage thereof entails a substantial loss. In addition, damage of the strainer involves the problem of leading to a shutdown of the overall coal-water slurry producing system.

Meanwhile, there are various factors that generally affect the performance of a continuous-type ball mill including the ball charge, the ball diameter, the mill rotating speed, the outlet structure of the mill and the dimensional ratio of the mill. As for the ball charge, one of 35 to 45% is generally used (refer to "Mineral Processing Plant Design" chapter 12, SME/AIME, 1979 and "Process Engineering of Size Reduction: Ball Milling L. G. Austin et al., AIME, 1984). Regarding the ball diameter, a mixture of various sizes of balls are employed which are best suited for obtaining a distribution of product particle sizes from a given distribution of raw-material particle sizes. As for the mill rotational speed, the speed used is one that is equivalent to approximately 65 to 80% of the critical speed (i.e., a speed at which centrifugal force and gravity are balanced, and at which balls rotate with the mill along the inner wall of the mill). With respect to the outlet structure of the mill, the diameter of the outlet is important. In addition, the ratio of the mill outlet diameter Dd to the mill inner diameter D, i.e., Dd/D, is set at approximately 0.2 to 0.3 on the basis of a ball space filling rate U of particles inside the mill, this rate having been proposed from the viewpoint of grinding efficiency (refer to "Process Engineering of Size Reduction: Ball Milling"). The ratio of mill dimensions, i.e., the ratio of the mill length L to the mill inner diameter D, i.e., L/D, is generally set at 2 to 3. However, a ball mill which is operated under these conditions suffer from a high rate of power consumption. For instance, in an experiment conducted by the present inventors under the following conditions, the cost of power consumption was 13.3% of the coal cost.

Ball mill: $\phi 300 \times 900L$ (L/D=2.5)
Rotational speed: 70% of the critical speed
Ball diameter: 40–17 mm
Ball charge: 35%
Ball outlet opening ratio: Dd/D=0.28
Feeding rate of coal: 6 kg/h
Coal concentration: 62.5%
Amount of surface active agent added: 0.7 wt. % with respect to coal
Amount of pH adjusting agent added: 0.1 wt. % with respect to coal
Result: The specific energy consumption for grinding was about 87 kWh/t.

If the unit price of electric power is assumed to be ¥ 23/kWh, the power cost becomes ¥ 20,001/ton. If the unit price of coal is assumed to be ¥ 15,000/ton, the power cost is equivalent to about 13.3% of the coal cost.

SUMMARY OF THE INVENTION

Accordingly, a primary object of the present invention is to provide an improved coal-water slurry producing system in which a strainer will not become blocked or damaged.

Another object of the present invention is to provide a continuous wet-type ball mill which is capable of producing a coal-water slurry in which the coal concentration is 60 wt. % or above and the particle size of which is such that the amount of particles which pass through a 200-mesh screen ranges between 60 wt. % and 90 wt. %.

In accordance with one aspect of the invention, there is provided a coal-water slurry producing system having a continuous wet-type ball mill for grinding coal with the addition of water and additives thereto to obtain a coal-water slurry, supplying means for supplying the coal-water slurry discharged from the ball mill to a filtering apparatus, the filtering apparatus for filtering the supplied coal-water slurry to remove coal particles of a predetermined particle size or above, and delivery means for delivering the filtered coal-water slurry containing coal particles of the predetermined particle size or below to a slurry storage tank, a combustion apparatus, or the like, the coal-water slurry producing system comprising: a screen apparatus disposed at an exit of the ball mill to remove coarse coal particles contained in the coal-water slurry; and recovery means for recovering the removed coarse coal particles at an entrance of the ball mill.

In accordance with another aspect of the invention, there is provided a continuous wet-type ball mill for grinding coal with the addition of water and additives thereto so as to produce a coal-water slurry with a coal concentration of 60 wt. % or above and with a particle size such that the amount of coal particles which pass through a 200-mesh screen ranges between 60 wt. % and 90 wt. %, wherein the mill exit diameter (Dd) of the ball mill and the mill inside diameter (D) thereof are such that the ratio between them ranges from 0.4 to 0.95.

In accordance with still another aspect of the invention, there is provided a continuous wet-type ball mill for grinding coal with the addition of water and additives thereto so as to produce a coal-water slurry with a coal concentration of 60 wt. % or above and with a particle size such that the amount of coal particles which pass through a 200-mesh screen ranges between 60 wt. % and 90 wt. %, wherein the ball mill is operated under the condition that the ratio of the slurry volume in the mill to the ball space volume in the mill ranges between 0.1 and 1.0.

DETAILED DESCRIPTION OF THE PREFERRED EMBODIMENTS

Figure 1:
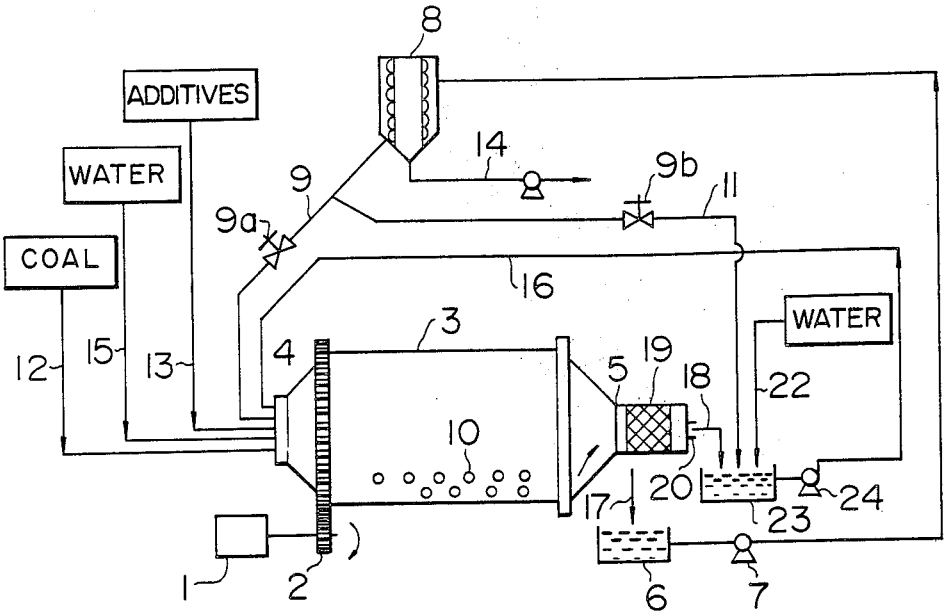
FIG. 1 is a diagram schematically illustrating a coal-water slurry producing system in accordance with the present invention.
Figure 2:
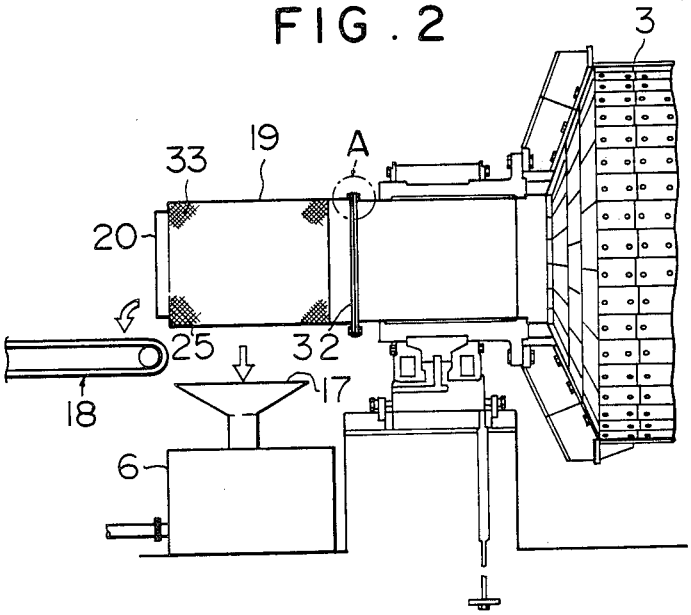
FIG. 2 is a side elevational view illustrating an exit portion of a ball mill provided with a screen device.
Figure 3:
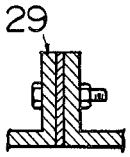
FIG. 3 is an enlarged detailed view of a portion A shown in FIG. 2.

FIG. 1 schematically illustrates a continuous wet-type ball mill 3 in accordance with the present invention and a coal-water slurry producing system embodying the present invention and including the ball mill. Reference numeral 3 denotes a continuous wet-type ball mill in accordance with the present invention, in which metal balls 10 are accommodated. The ball mill 3 is connected to a motor 1 via a gear 2 and is rotated by the motor 1. Supplying pipes 12, 15, 13 for respectively supplying coal, water and additives such as a surface active agent and a pH adjusting agent are connected to an entrance 4 of the ball mill 3. A screen 19 apparatus which will be described hereinafter is connected to an exit 5 of the ball mill 3. A sump tank 6 for temporarily storing a coal-water slurry taken out from the ball mill 3 is provided below the screen apparatus 19. Furthermore, a sump pump 7 for feeding the coal-water slurry to a strainer 8 which removes coal particles of a predetermined particle size or above is connected to the sump tank 6. Connected to the strainer 8 are a product line 14 for supplying the coal-water slurry containing coal particles of a predetermined particle size or below to a storage tank or a combustion apparatus as well as a return line 9 for returning the coal-water slurry containing coal particles of a predetermined particle size or above to the entrance 14 of the ball mill 3. A shut-off valve 9*a* is provided at the return line 9. A branch line 11 is connected to an upstream portion of the shut-off valve 9*a* of the return line 9, is provided with a shut-off valve 9*b*, and is led to a recovery tank 23. The recovery tank 23 is used to temporarily store the coarse coal particles not passing through the screen apparatus 19 and the screen apparatus is provided with a conveying apparatus 18 for conveying the coarse coal particles from an outlet port 20 of the screen apparatus 19. Furthermore, connected to the recovery tank 23 are a line 22 for supplying water and a line 16 having a pump 24 for returning the coarse coal particles temporarily stored in the recovery tank 23 to the entrance 4 of the ball mill 3. The screen apparatus is connected to the exit 5 of the ball mill 3 by means of a flange 29, as shown in FIG. 3. The screen apparatus 19 is substantially cylindrically shaped and is provided with a slurry entrance 32, an outlet 20 for coarse coal particles disposed on the side thereof opposite to the entrance 32, and a metal screen 33 disposed between the slurry entrance 32 and the outlet 20 for coarse coal particles to allow the coal-water slurry containing coal particles other than the coarse coal particles to pass therethrough. The metal screen 33 is preferably of a mesh size of 10 to 16. A collector 17 and the sump tank 6 are disposed below the metal screen 33, and the coal-water slurry containing coal particles other than the coarse coal particles is temporarily stored in the sump tank 6 by means of the collector 17. A belt conveyor 18 for a recovery apparatus is disposed below the outlet 20 for coarse coal particles, and the coarse coal particles are conveyed to the recovery tank 23. The coarse coal particles stored in the recovery tank 23 can be fed back to the mill entrance 4 by means of a belt conveyor. The embodiment shown in FIG. 1 is arranged such that water is replenished to the coarse coal particles to such an extent that is necessary for pumping, and the coarse coal particles are returned to the mill entrance 4 by a slurry pump 24 and is ground again. It should be noted that the coal-water slurry containing coal particles of the predetermined particle size or greater may be recovered in the recovery tank 23 via the valve 9*b* and the branch line 11. In this case, replenishment of water to the recovery tank 23 may be omitted or the amount of water to be replenished may be reduced.

Thus, since the coal-water slurry which has been discharged from the ball mill 3 is filtered by the screen apparatus 19 before being fed to the strainer 8 which has fine meshes and is expensive as an apparatus, thereby removing the coarse coal particles contained in the coal-water slurry the load applied to strainer 8 can be alleviated and it is possible to prevent the blockage or damage of the strainer. Furthermore, the coarse coal particles separated by the screen apparatus 19 are recovered again into the entrance 4 of the ball mill 3 and is reground, so that this system is economical. In addition, since the coarse coal particles separated by the screen apparatus 19 can be recovered in a liquefied form by being mixed with the coal-water slurry separated by the strainer 8, thereby facilitating recovery.

The present invention is also directed to the structure of a ball mill from the viewpoint of reduction of power consumption. Referring next to FIGS. 4 to 9, description will be made of a ball mill in accordance with the present invention.

As described above, consideration has hitherto been paid to the fractional ball space filling of the coal particles U as a factor affecting the grinding efficiency of the ball mill. However, this fractional ball space filling U was originally devised for dry coal as an object. It is therefore considered that this fractional ball space filling is not sufficient in cases where the coal-water slurry is used as the object. Hence, the present inventors decided to use the ratio of the volume of the slurry to the volume of the ball space, i.e., the fractional ball space filling of the slurry Us.

Incidentally, if it is assumed that the apparent density of coal is $\rho p$, the density of the slurry is $\rho s$, and the concentration of coal is C, the following formula holds between U and Us for an identical amount of coal:

$$U = Us \times C \times (\rho s / \rho p)$$

For instance, if $\rho p = 0.84$, $\rho s = 1.22$, and C=62.5 wt. %, then U=0.9 Us.

Figure 4A:
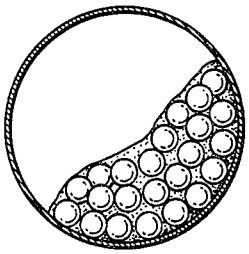
FIGS. 4*a* and 4*b* are cross sectional views of a mill explaining a fractional ball space filling of the slurry Us in a ball mill.
Figure 4B:
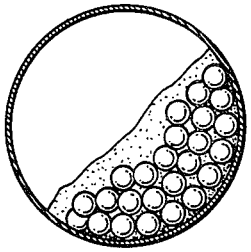

The grinding efficiency drops when the fractional ball space filling of the slurry Us exceeds 1, as in the case of the fractional ball space filling of the particles U. As shown in FIG. 4*a*, when the fractional ball space filling of the slurry Us is equal to 1, namely, when the slurry is filled in the space defined by the balls, grinding by the balls is carried out. However, when the fractional ball space filling of the slurry Us becomes greater than 1, the slurry exists in the space other than that defined by the balls, so that resistance becomes large, and the movement of the balls is restricted. Consequently, the grinding efficiency declines.

Figure 5:
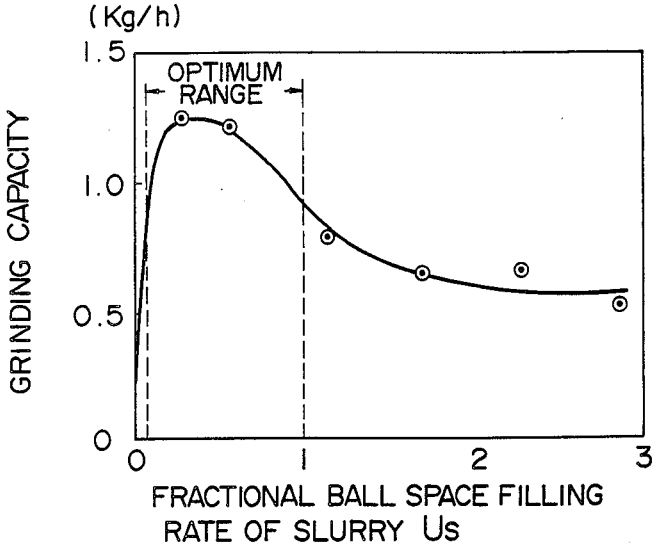
FIG. 5 is a graph illustrating the relationship between the fractional ball space filling of the slurry Us and the grinding capacity.

In order to determine an optimum range of the fractional ball space filling of the slurry Us concerning the grinding efficiency, the present inventors conducted a grinding experiment by varying the amount of coal charged into the mill by using a compact batch-type ball mill with a mill inner diameter of 250 mm and an inner capacity of 10 liters (the ball charge: 35%; the percentage of the critical speed: 70%). FIG. 5 shows the result thereof, in which the grinding efficiency at the time when 70% of the particles contained in the coal-water slurry pass through a 200-mesh screen is plotted with respect to the fractional ball space filling of the slurry Us. As is apparent from this drawing, the grinding capability of the mill is high when the fractional ball space filling of the slurry Us ranges between 0.1 and 1.

Figure 6:
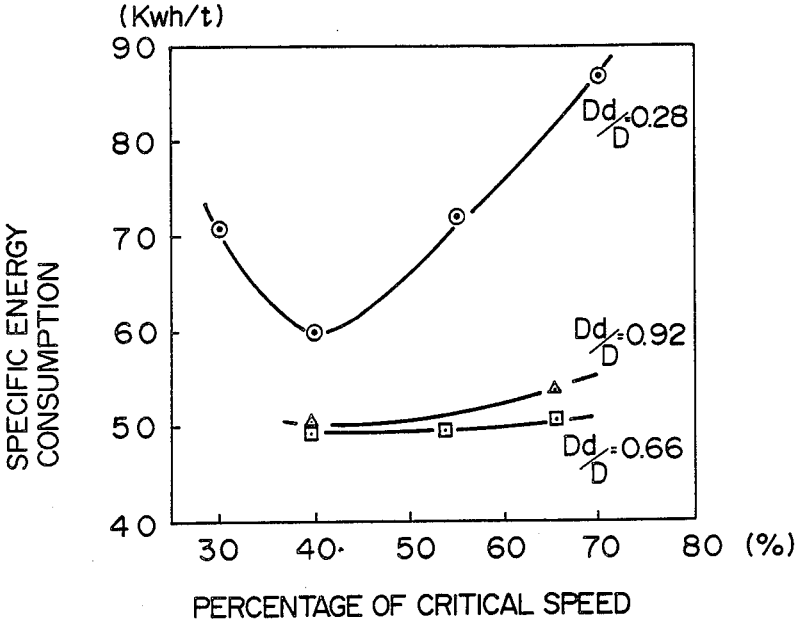
FIG. 6 is a graph illustrating the relationship among the specific energy consumption, the percentage of critical speed, and the exit opening ratio.
Figure 7:
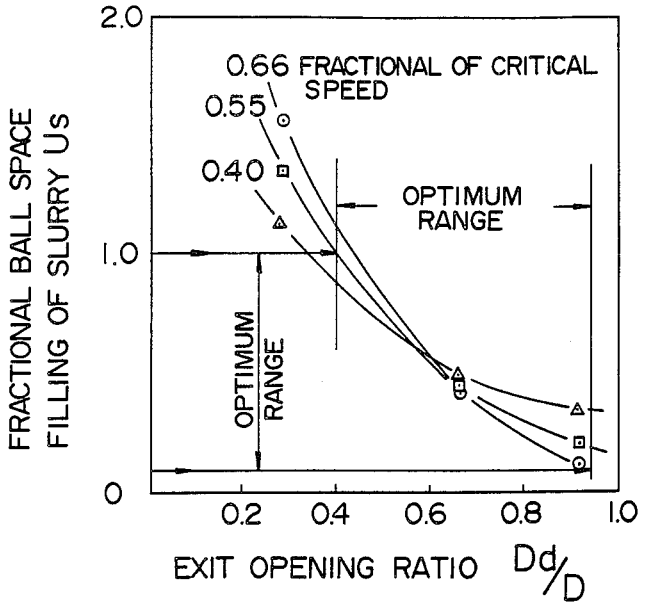
FIG. 7 is a graph illustrating the fractional ball space filling of the slurry, the percentage of critical speed ratio, and the exit opening ratio.
Figure 8:
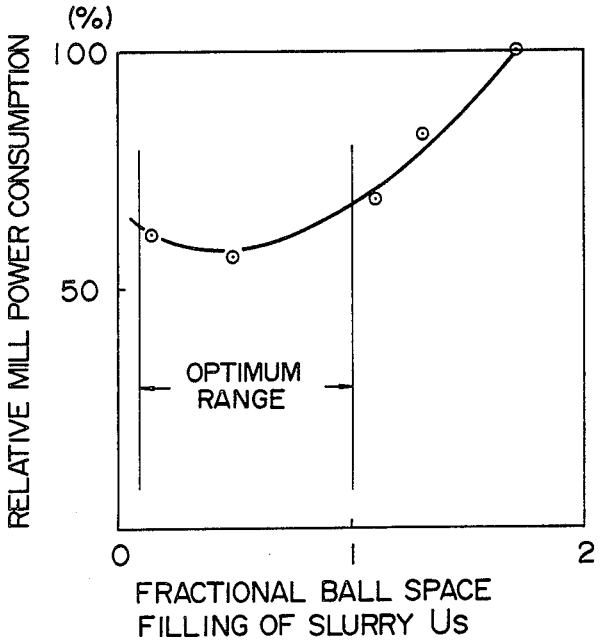
FIG. 8 is a graph illustrating the relationship between the fractional ball space filling of the slurry and the relative mill power consumption.

In order to determine an exit opening ratio, i.e., the ratio of the exit diameter to the inside diameter of the ball mill for maintaining the fractional ball space filling of slurry Us in the range of 0.1 to 1, the present inventors conducted an experiment under the following conditions:

- Ball mill: 360 mm (inside diameter), 900 mm (length)
- Ball diameter: 40–17 mm
- Ball charge: 35%
- Coal: coal A (HGI=36)
- Surface active agent: 0.7 wt. % with respect to the weight of coal
- pH adjusting agent: 0.1 wt. % with respect to the weight of coal
- Concentration of coal: 62.5%
- Particle size of the coal-water slurry: 75% passing 200 mesh
- Viscosity: 1,000 cP
- Exit opening ratio: Dd/D=three kinds of 0.28, 0.66, and 0.92
- Rotational speed: 30–70% of the critical speed The results are shown in FIGS. 6, 7 and 8. FIG. 6 is a graph illustrating the relationship between the percentage of the critical speed and the specific energy consumption using the mill exit opening ratio as a parameter. FIG. 7 is a graph illustrating the relationship between the exit opening ratio Dd/D and the fractional ball space filling of the slurry Us using the percentage of the critical speed as a parameter. FIG. 7 shows that, in order to maintain the fractional ball space filling Us in the range of 0.1 to 1, the mill exit opening ratio Dd/D must be in the range of 0.4–0.95. It can be appreciated that by setting the mill exit opening ratio Dd/D in that range, the specific energy consumption can be reduced. FIG. 8 is a graph illustrating the relationship between the fractional ball space filling of the slurry Us and the power consumption of the mill compared with the power consumption of the mill having a mill exit opening ratio Dd/D of 0.28 (corresponding to the prior art). As is apparatus from this graph, by maintaining the fractional ball space filling of the slurry Us in the range of 0.1–1, the level of power consumption can be reduced by 60–70% as compared with a conventional level.

From the foregoing results, the optimum range of the mill exit opening ratio Dd/D for maintaining the fractional ball space filling of the slurry Us in the range of 0.1–1 is 0.4–0.95.

Figure 9A:
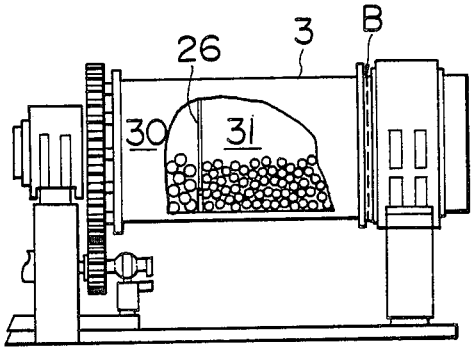
FIGS. 9*a* and 9*b* are a side-elevational view of a ball mill having a two-compartment structure and a front-elevational view of a exit slit plate thereof.
Figure 9B:
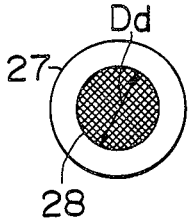

Referring next to FIGS. 9*a*, 9*b*, description will be made of the structure of ball mill designed in view of the fact that large-diameter balls are suited for grinding large-diameter particles, and small-diameter balls for grinding small-diameter particles. The ball mill 3 is divided into two compartments 30, 31 by means of a partition plate 26 having slit holes. An exit plate 27 shown in FIG. 9*b* is inserted at the position indicated by the arrow B in FIG. 9*a*. Large-diameter balls are filled in the first compartment 30 on the entrance side, while small-diameter balls are filled on the second compartment 31 on the exit side. This arrangement is provided to effect grinding efficiently by filling large-diameter balls in the first compartment 30 on the entrance side into which large-diameter coal particles are supplied and by filling small-diameter balls in the second compartment 31 on the exit side where a large volume of ground coal particles are present. Using a ball mill having the above-described arrangement, an experiment for producing the coal-water slurry was carried out under the following conditions:

- Ball mill: a two-compartments type, 650 mm (inside diameter), 1250 mm (length), L/D=1.9
- Ball diameter: 50 mm or less
- Ball charge: 35%
- Coal: coal A (HGI=36)
- Surface active agent: 0.5 wt. % with respect to the weight of coal
- pH adjusting agent: 0.1 wt. % with respect to the weight of coal
- Mill rotational speed: 70% of the critical speed
- Exit opening ratio: 0.6

As a result of tests conducted by charging the feed rate of particles ground and the concentration of coal under the conditions listed above, the conditions for maintaining the slurry viscosity at about 1,000 cp and the amount of particles passing through the 200-mesh screen at 75% were 60 kg/h in terms of the amount of particles ground and 63 wt. % in terms of the concentration of coal. At that time, the specific power consumption was approximately 47 kWh/t coal. Thus, when producing the slurry of the same viscosity and particle size, the level of power consumption for grinding the slurry having a 0.5% higher concentration than the prior art can be reduced from 87 kWh/t to 47 kWh/t, and the amount of the surface active agent used can be reduced from 0.7% to 0.5%. This is attributable to the fact that the mill exit opening ratio Dd/D was set at 0.6 to maintain the fractional ball space filling of the slurry Us at 0.6, and that the ball mill was partitioned into two compartment, the first compartment on the entrance side being filled with large-diameter balls and the second compartment on the exit side, with small-diameter balls.

Thus, by maintaining the ratio of the volume of the slurry to the volume of the ball space in the range of 0.1 to 1, it is possible to reduce the level of power consumption. In addition, the level of power consumption can also be reduced by setting the ratio of the mill exit diameter Dd to the mill inside diameter D, Dd/D, in the range of 0.4–0.95.

The ball mill used in the coal-water slurry producing system shown in FIG. 1 should not be restricted to the one shown in FIGS. 4 to 9. It goes without saying that a conventional ball mill can also be used in the coal-water slurry producing system concerned.

In accordance with the present invention, there is provided an improved coal-water slurry producing system in which a strainer will not be blocked or damaged by coarse coal particles.

In addition, in accordance with the present invention, there is provided a continuous wet-type ball mill with a reduced power consumption.

What is claimed is:

1. A coal-water slurry producing system comprising:

a continuous type ball mill comprising a rotatable cylindrical mill with an inlet and an outlet, respectively, provided at each end of the mill and arranged at a rotational center of the mill for grinding coal with water and additives to produce a coal-water slurry;

a rotatable screen apparatus disposed at said mill outlet to remove coarse coal particles contained in the coal-water slurry produced by said ball mill, said screen apparatus comprising a slurry inlet port connected to said mill outlet, an outlet port for coarse coal particles provided on a side opposite to said slurry inlet port and a cylindrical metal screen disposed between said slurry inlet port and said outlet port and adapted to pass the coal-water slurry containing coal particles other than the coarse coal particles therethrough;

strainer means for removing coal particles of a predetermined size and above from the slurry, said strainer means comprising a stationary outer casing, an inlet provided in said outer casing for entry of the slurry, a screen for filtering the slurry, a product outlet provided on one side of the metal screen for discharging filtered slurry from the outer casing and a returning outlet provided in said outer casing on another side of the screen to discharge the non-filtered slurry;

feeding means for feeding the coal-water slurry from said screen apparatus to said inlet of said strainer means;

delivery means for delivering the coal-water slurry filtered by said strainer means from said product outlet of said strainer means to a slurry storage tank;

first returning means for returning the non-filtered coal-water slurry to said mill entrance; and second returning means for returning the coarse coal particles removed by said screen apparatus to said mill entrance.

2. A coal-water slurry producing system as claimed in claim 1, wherein said second returning means comprises a recovery tank to store the coarse coal particles removed by said screen apparatus, a conveying apparatus conveying the coarse coal particles from said outlet port of said screen apparatus to said recovery tank, a first line supplying water to said recovery tank and a second line returning the coarse coal particles stored in the recovery tank to said mill entrance.

3. A coal-water slurry producing system as claimed in claim 2 further comprising a third line connected from said returning outlet of said strainer means to said recovery tank and supplying a part of the non-filtered coal-water slurry to said recovery tank.

4. A coal-water slurry producing system as claimed in claim 1, wherein said ball mill has a ratio of mill exit diameter to mill inside diameter ranging between 0.4 and 0.95.

5. A coal-water slurry producing system as claimed in claim 1, wherein said ball mill has a multi-compartment structure in which a plurality of compartments are connected in series.

6. A coal-water slurry producing system as claimed in claim 1, wherein said metal screen of said screen apparatus has a mesh size of 10 to 16.

* * * * *